US008262084B2

(12) United States Patent
Nishikata et al.

(10) Patent No.: US 8,262,084 B2
(45) Date of Patent: Sep. 11, 2012

(54) SHEET FEEDING APPARATUS AND IMAGE FORMING APPARATUS WITH SHEET FEEDING CASSETTE AND ASSOCIATED LOCKING MEANS

(75) Inventors: Kazushi Nishikata, Odawara (JP); Hisayuki Tomura, Izunokuni (JP); Akio Nemoto, Susono (JP); Kei Sawanaka, Susono (JP); Masato Suzuki, Mishima (JP); Yasuyoshi Hayakawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/033,712

(22) Filed: Feb. 24, 2011

(65) Prior Publication Data

US 2011/0140355 A1 Jun. 16, 2011

Related U.S. Application Data

(63) Continuation of application No. 11/567,832, filed on Dec. 7, 2006, now Pat. No. 7,913,996.

(51) Int. Cl.
*B65H 1/00* (2006.01)

(52) U.S. Cl. ..... 271/162; 271/145

(58) Field of Classification Search ..... 271/162–164, 271/117, 145; 399/361, 381, 388, 391–393
See application file for complete search history.

(56) References Cited

U.S. PATENT DOCUMENTS

| | | | | |
|---|---|---|---|---|
| 5,139,252 | A * | 8/1992 | Morita et al. | 271/117 |
| 5,156,388 | A * | 10/1992 | Morita | 271/109 |
| 6,695,303 | B2 * | 2/2004 | Okada et al. | 271/9.12 |
| 2002/0130458 | A1 * | 9/2002 | Okada et al. | 271/9.12 |

FOREIGN PATENT DOCUMENTS

JP 2004-256287 9/2004

* cited by examiner

*Primary Examiner* — Gerald McClain
(74) *Attorney, Agent, or Firm* — Fitzpatrick, Cella, Harper & Scinto

(57) ABSTRACT

The detachment of a feed roller rotatably supported by a holding portion provided in the main body of an apparatus, and held detachably in the axial direction thereof is restricted by a locking device. The locking device is made movable to a lock position and a lock releasing position for permitting the detachment of the feed roller. Further, when the locking device is in the lock releasing position when a sheet stacking portion is mounted, the locking device is moved to the lock position by a position changeover device in operative association with the mounting operation of the sheet stacking portion.

4 Claims, 20 Drawing Sheets

SHEET FEEDING APPARATUS AND IMAGE FORMING APPARATUS WITH SHEET FEEDING CASSETTE AND ASSOCIATED LOCKING MEANS

This is a continuation of U.S. patent application Ser. No. 11/567,832, filed Dec. 7, 2006, and allowed Dec. 2, 2010.

BACKGROUND OF THE INVENTION

1. Field of the Invention

The invention relates to a sheet feeding apparatus and an image forming apparatus, and particularly to a sheet feeding apparatus having detachably mounted thereon a feed roller for feeding a sheet.

2. Description of the Related Art

Heretofore, in an image forming apparatus such as a printer, a copying machine or a facsimile apparatus, there has been provided a sheet feeding apparatus for separating and feeding out sheets one by one from sheet stacking means on which a plurality of sheets are stacked.

FIG. 12 illustrates the construction of such a conventional sheet feeding apparatus, and in FIG. 12, the reference numeral 70 designates a sheet feeding cassette, the reference numeral 1 denotes a feed roller for feeding sheets P contained in the sheet feeding cassette 70, and the reference numeral 72 designates a cassette tub which is the frame member of the sheet feeding cassette 70. The reference numeral 73 denotes an inner plate provided for pivotal movement in a vertical direction in the cassette tub 72, and the reference numeral 74 designates an inner plate urging spring for urging the inner plate 73 toward the feed roller 1, and the inner plate 73 is urged toward the feed roller 1 by this inner plate urging spring 74. The sheets P stacked on the inner plate 73 are successively fed out by the rotation of the feed roller 1. The reference numeral 76 denotes a separation pad brought into pressure contact with the feed roller 1 to thereby separate the sheets fed out one by one.

The feed roller 1 is provided with a sheet abutment portion 1*a* formed of a frictional material such as frictional rubber, and having a shape in which a part of the circumferential portion is cut away, and rotatable members 3 disposed on the opposite sides of this sheet abutment portion 1*a*. In a standby state before the sheet P is fed out, the cut-away portion of the sheet abutment portion 1*a* faces the sheet P, as shown in FIG. 12. When in this state, the sheet P is adapted to abut against the rotatable members 3.

When in this state, the feed roller 1 is rotated, the sheet abutment portion 1*a* abuts against the sheet P, and by the utilization of the frictional force of the sheet abutment portion 1*a*, the uppermost one P1 of the sheets P stacked on the sheet feeding cassette 70 is fed out to an image forming portion. If a plurality of sheets are about to be fed at a time, they are separated by the separation pad 76 and only the uppermost sheet is fed.

Now, in the conventional sheet feeding apparatus of such a construction, when the frictional rubber (of the sheet abutment portion 1*a*) of the feed roller 1 is deteriorated by abrasion or the like, a reduction in feeding performance may be caused. Therefore, design is made such that the feed roller 1 can be detachably mounted on the main body of the sheet feeding apparatus so that the feed roller 1 can be periodically interchanged.

Here, as described in Japanese Patent Application Laid-open No. 2004-256287, there is a sheet feeding apparatus in which a feed roller is made into a unit to facilitate the interchanging work of the feed roller by a user or a serviceman, and is adapted to be slid along the axis of the feed roller and detached from the main body of the apparatus.

FIGS. 13 and 14 show the construction of such a feed roller made into a unit. This feed roller 1 has a roller body portion 1A provided with a sheet abutment portion 1*a* formed of cylindrical frictional rubber, and a core metal 1*b* having the sheet abutment portion 1*a* secured to the central portion thereof. Further, a convex fitting portion 1*c* is formed on one end portion of the core metal 1*b* of this roller body portion 1A, and a concave fitting portion 1*d* is formed on the other end portion thereof.

Cylindrical urging means 5 such as, for example, a coil spring, is inserted into the concave fitting portion 1*d*, whereafter a shaft member 2 constituting a first roller shaft provided on one side of the roller body portion 1A is slidably inserted thereinto.

Also, a resilient restraining claw 1*e* for restraining a first rotatable member 3*a* mounted on the shaft member 2 is provided in the concave fitting portion 1*d* which is a shaft holding portion for slidably holding the shaft member 2. The first rotatable member 3*a* is mounted through this resilient restraining claw 1*e*, whereby the shaft member 2 is slidably held on the roller body portion 1A.

Accordingly, the shaft member 2 is held in an outwardly urged state on the roller body portion 1A by the compressed urging means 5. At this time, the urging means 5 can be further compressed, whereby when the distal end of the shaft member 2 is fixed, the roller body portion 1A can be slid to the distal end side of the shaft member 2.

On the other hand, as shown in FIG. 14, the convex fitting portion 1*c* provided on one end portion of the core metal 1*b* constitutes a second roller shaft, and an engagement groove 1*g* formed in the distal end portion is adapted to be fitted to a drive input shaft 6 provided on the main body of the sheet feeding apparatus. Thus, the feed roller 1 is also adapted to be rotated with the rotation of the drive input shaft 6. The reference character 3*b* designates a second rotatable member rotatably restrained on the roller body portion 1A.

FIGS. 15A and 15B show a state in which the feed roller 1 thus made into a unit is rotatably held by a holder 10 which is a holding portion provided in the sheet feeding apparatus. In FIGS. 15A and 15B, the reference characters 4*a* and 4*b* denote first and second bearings, respectively, detachably held on the holder 10 by a resilient restraining claw or the like, not shown, and constituting first and second journalling portions, and the feed roller 1 is rotatably and resiliently held on the holder 10 through the first and second bearings 4*a* and 4*b*.

When the feed roller 1 is to be detached, the sheet feeding cassette 70 is first detached, whereafter as shown in FIGS. 16A and 16B, the roller body portion 1A is slid in a detaching direction indicated by the arrow along the first roller shaft 2. Thereby, the convex fitting portion 1*c* which is the second roller shaft is moved with integrally with the roller body portion 1A and comes off from the fitting with the second bearing 4*b*, and as shown in FIG. 16B, the feed roller 1 becomes capable of being tilted as indicated by the arrow.

As the result, the feed roller 1 can be detached as shown in FIG. 17. Also, when the feed roller 1 is to be mounted, it can be mounted by a converse procedure. As described above, the interchange of the feed roller 1 can be performed easily.

On the other hand, as another example of the sheet separating means carried on the sheet feeding apparatus, there is one using a separation roller having a torque limiter disposed coaxially therewith or containing a torque limiter therein. This separation roller is adapted to be brought into pressure contact with the feed roller, and separate the sheet by the braking torque of the torque limiter.

For example, when a plurality of sheets are present between the feed roller and the separation roller, relatively small rotational torque acts on the torque limiter and therefore, the torque limiter is adapted to block the rotation of the separation roller associated with the rotation of the feed roller. Thereby, a single sheet can be conveyed by a conveying roller, and other sheets can be prevented from being conveyed by the separation roller.

When only one sheet is present between the feed roller and the separation roller, great rotational torque acts on the torque limiter, and the torque limiter permits the rotation of the separation roller associated with the rotation of the feed roller. Thereby, the sheet is conveyed.

FIG. 18 shows the construction of a conventional sheet feeding apparatus in which the sheet is separated by a separation roller using such a torque limiter.

In FIG. 18, the reference numeral 11 designates a cylindrical feed roller free of a cut-away portion, and the reference numeral 62 denotes a separation roller, and a torque limiter 62*a* is provided coaxially with this separation roller 62. The reference numeral 63 designates a separation roller holder for supporting the separation roller 62 for sliding in a vertical direction, and the reference numeral 64 denotes a spring for urging the separation roller 62 toward the feed roller 11.

The separation roller 62 is brought into pressure contact with the separation roller holder 63 interposed therebetween by the spring 64, whereby a sheet P fed out by the feed roller 11 is separated by the braking torque of the torque limiter of the separation roller 62, and is conveyed toward the downstream.

FIG. 19 is an exploded perspective view of the feed roller 11, and in FIG. 19, the reference character 11A designates a roller body portion, the reference character 11*a* denotes a sheet abutment portion (e.g. a rubber material), the reference character 11*c* designates a convex fitting portion (second roller shaft), the reference character 11*d* denotes a concave fitting portion, and the reference character 11*e* designates a resilient restraining claw. The reference character 11*f* denotes a flange portion, the reference character 11*g* designates an engagement groove engaged with a drive input shaft, the reference numeral 12 denotes a shaft member constituting a first roller shaft, and the reference numeral 15 designates urging means such as a coil spring for outwardly urging the shaft member (first roller shaft). The functions of these members and the like are the same as the function of the feed roller used in combination with the separation pad already described and therefore need not be described.

The reference numeral 13 denotes an auxiliary cap for slidably supporting the shaft member 12 on the roller body portion 11A, like the first rotatable member 3*a* in the feed roller used in combination with the separation pad.

This feed roller 11, like the feed roller 1 used in combination with the separation pad shown in FIG. 13 already described, is such that the roller body portion 11A is slidably held along the first roller shaft (shaft member 12). Again in this feed roller 11, as shown in FIG. 20, the roller body portion 11A is slid in the direction indicated by the arrow, whereby the feed roller 11 can be interchanged easily by the user or the serviceman.

However, in the conventional sheet feeding apparatus and image forming apparatus wherein the feed roller is thus detachably mounted and is made interchangeable, there are the following problems.

(1) In a case where a sheet has been jammed between the feed roller and the sheet separating means (the separation pad or the separation roller), when the jam is to be cleared, the feed roller may be inadvertently detached.

This is because there is the possibility of vehement bend or breakage occurring to the jammed sheet, and there is the possibility that the user (or the serviceman) may perforce pull the sheet thus causing vehement bend or breakage during the clearance of the jam. Particularly, in a case where the clearance of the jam is done without the sheet feeding cassette being detached from the apparatus, that is, without the abutment between the feed roller and the sheet separating means being released, the bend or slack of the jammed sheet may be caught by the end portions of the feed roller to thereby slide the feed roller.

(2) In a case where the mounting direction of the sheet feeding cassette is the same as the sliding direction of the feed roller, when jam has occurred with a sheet nipped between the feed roller and the sheet separating means, if the sheet feeding cassette is drawn out, there is the possibility of the jammed sheet sliding the feed roller.

(3) There is the possibility that an unexpected great force may be applied to the feed roller during the transportation of the apparatus to thereby detach the feed roller.

In a case where the feed roller has been inadvertently detached under such situations as noted above, if the user can become aware of this, the feed roller can be re-mounted easily, but if the user does not become aware of this, he will judge it to be trouble of the apparatus.

If here, a sensor for exclusive use is provided so as to detect the mounted state of the feed roller, it will result in a high cost. Also, if the urging force (spring force) of the urging means contained in the feed roller is strengthened so that the feed roller may not be detached, the interchanging work of the feed roller will become difficult.

So, it is conceivable to provide a locking member to prevent the feed roller from being inadvertently detached. In a case where the locking member is thus provided, when the feed roller is to be interchanged, the locking member is changed over a lock position to a lock releasing position, whereafter the feed roller is interchanged. Also, design is made such that after the interchange of the feed roller, the locking member is changed over from the lock releasing position to the lock position.

However, if the locking member is thus provided, there will be a case where after the interchange of the feed roller, the user forgets to change over the locking member to the lock position. In such case, when the sheet feeding cassette is to be mounted thereafter, the locking member may sometimes contact with the sheets stacked on the sheet feeding cassette, and when the locking member thus contacts with the sheets, there will occur the inconvenience that the feeding of the sheets at appropriate timing is not performed, or the sheets are injured.

SUMMARY OF THE INVENTION

So, the present invention has been made in view of such a situation, and has as its object to provide a sheet feeding apparatus and an image forming apparatus in which after the interchange of a feed roller, a locking member can be reliably changed over to a lock position.

The present invention provides a sheet feeding apparatus provided with sheet stacking means detachably mounted on the main body of the apparatus, and a feed roller for feeding sheets stacked on the sheet stacking means, the sheet feeding apparatus being further provided with:

a holding portion provided in the main body of the apparatus, having the feed roller rotatably supported thereto, and holding the feed roller detachably in the axial direction thereof; and a locking member movable to a lock position for restricting the detachment of the feed roller, and a lock releasing position for permitting the detachment of the feed roller, wherein when the locking member is in the lock releasing position with the sheet stacking means drawn out from the main body of the apparatus, the locking member is moved to the lock position in association with the mounting operation of the sheet stacking means.

DESCRIPTION OF THE PREFERRED EMBODIMENTS

The best forms for carrying out the present invention will hereinafter be described in detail with reference to the drawings.

Figure 1:
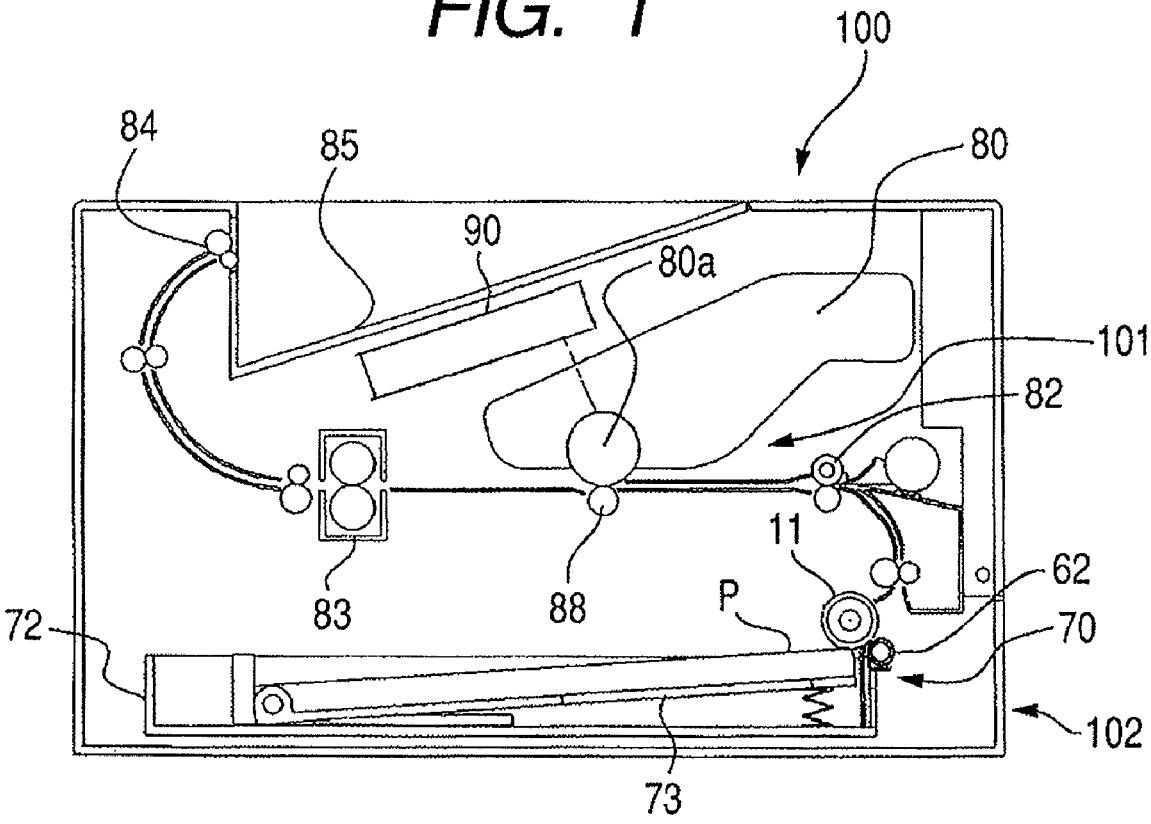
FIG. 1 is a view schematically showing the constructions of a sheet feeding apparatus according to a first embodiment of the present invention and a laser printer as an example of an image forming apparatus provided with the same.
Figure 18:
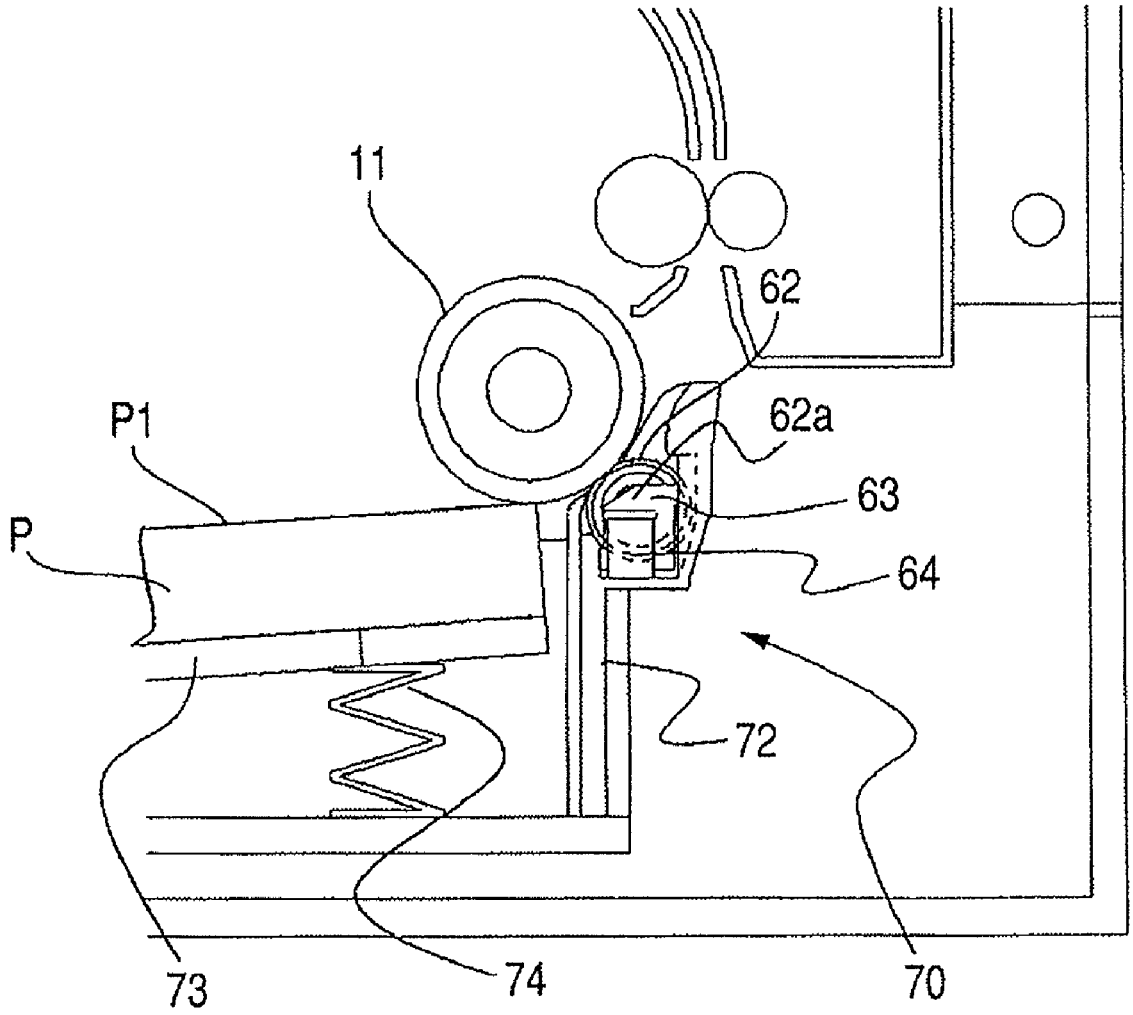
FIG. 18 PRIOR ART
FIG. 18 shows another construction of the conventional sheet feeding apparatus.
Figure 19:
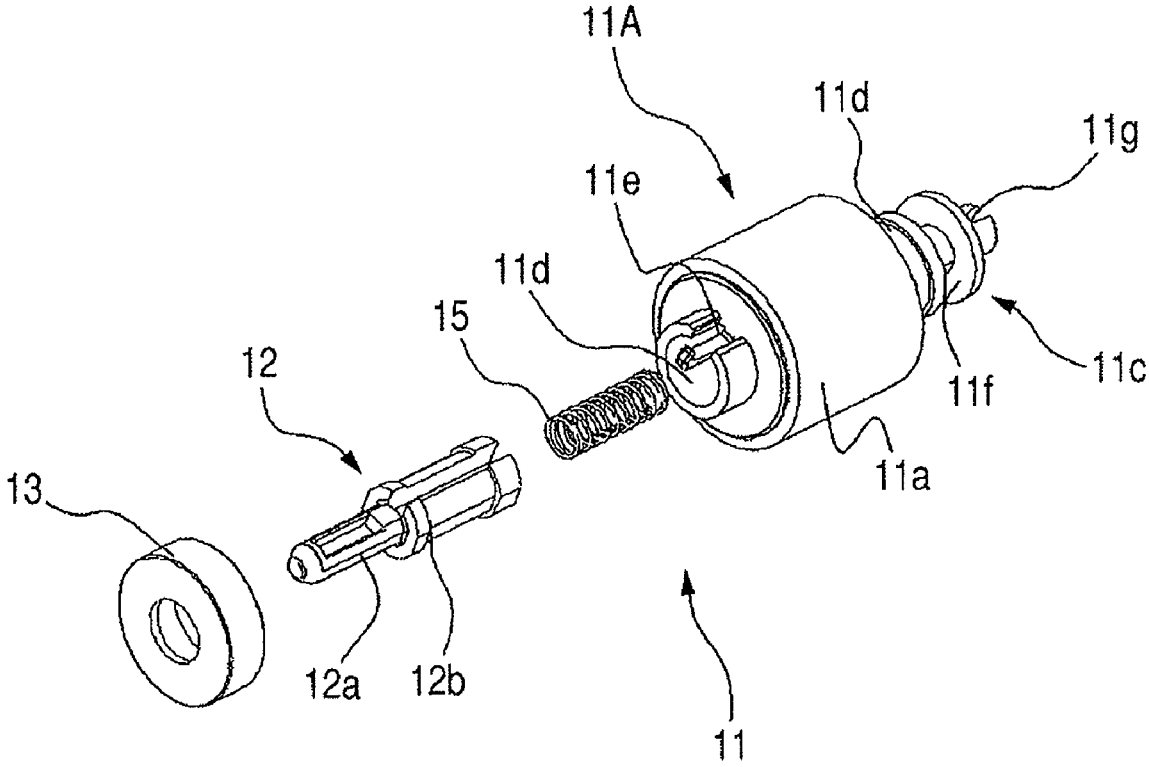
FIG. 19 PRIOR ART
FIG. 19 is an exploded perspective view of a feed roller provided in the conventional sheet feeding apparatus.

FIG. 1 is a view schematically showing the constructions of a sheet feeding apparatus according to a first embodiment of the present invention and a laser printer as an example of an image forming apparatus provided with the same. In FIG. 1, the same reference characters as those in FIG. 18 previously described designate the same or corresponding portions.

In FIG. 1, the reference numeral 100 designates the main body of the laser printer (hereinafter referred to as the main body of the apparatus, and in the lower portion of this main body 100 of the apparatus, there is provided a sheet feeding apparatus 102 for feeding a sheet to an image forming portion 101.

The image forming portion 101 is provided with a cartridge unit 80 having a photosensitive drum 80*a* as an image bearing member, and a laser scanner 90 for exposing the photosensitive drum 80*a*. During image formation, the photosensitive drum 80*a* is exposed by the laser scanner 90 to thereby form a latent image on the surface of the photosensitive drum, whereafter this latent image is developed to thereby form a toner image on the surface of the photosensitive drum.

Also, the sheet feeding apparatus 102 is provided with a sheet feeding cassette 70 as sheet stacking means detachably provided in the main body 100 of the apparatus, and a feed roller 11 provided above this sheet feeding cassette 70 for feeding out sheets P contained in the sheet feeding cassette 70. It is further provided with a separation roller 62 as sheet separating means brought into pressure contact with the feed roller 11 for separating the sheets P fed out by the feed roller 11. In the present embodiment, the main body of the sheet feeding apparatus is constituted by the main body 100 of the apparatus.

The thus constructed sheet feeding apparatus 102 feeds out the sheets P contained in the sheet feeding cassette 70 by the feed roller 11 in parallel with the toner image forming operation of the above-described image forming portion 101, and thereafter separates the sheets P one by one by the separation roller 62. Thereafter, the sheet P is conveyed to a transfer portion formed by the photosensitive drum 80*a* and a transfer roller 88 at predetermined timing by a pair of registration rollers 82.

As regards the sheet P conveyed to the transfer portion, a toner image formed on the surface of the photosensitive drum 80*a* is transferred thereto in this transfer portion, whereafter the sheet P is conveyed to a fixing portion 83, where it is heated and pressurized, whereby the toner image is fixed thereon. After the image has been fixed in this manner, the sheet P is discharged to a discharging portion 85 provided on the upper surface of the main body of the apparatus by a pair of sheet discharging rollers 84.

Figure 2A:
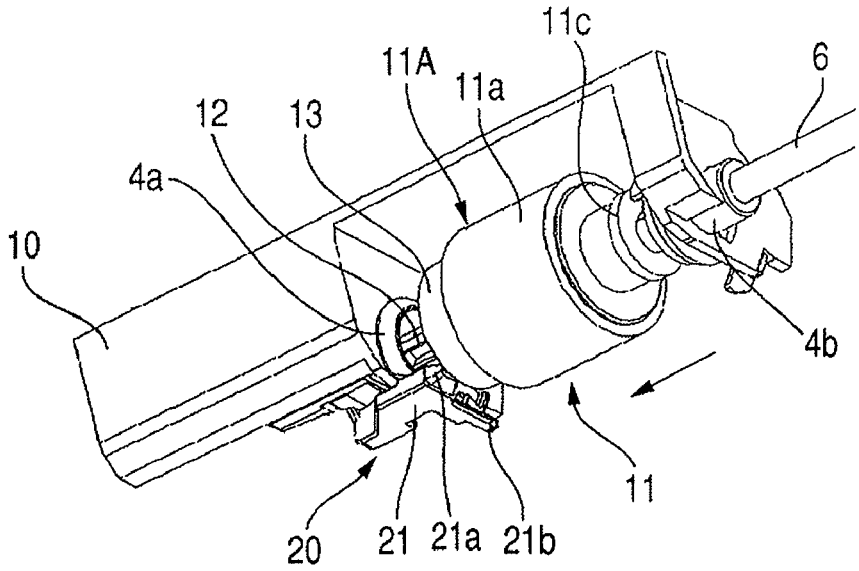
FIGS. 2A and 2B are views showing the construction of the feed roller portion of the sheet feeding apparatus.
Figure 2B:
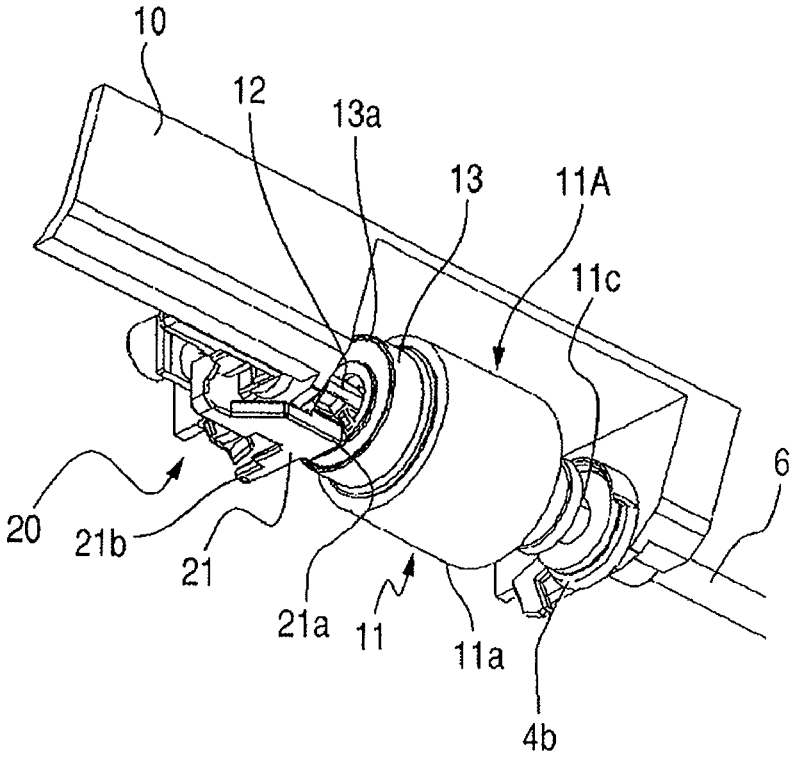
Figure 20:
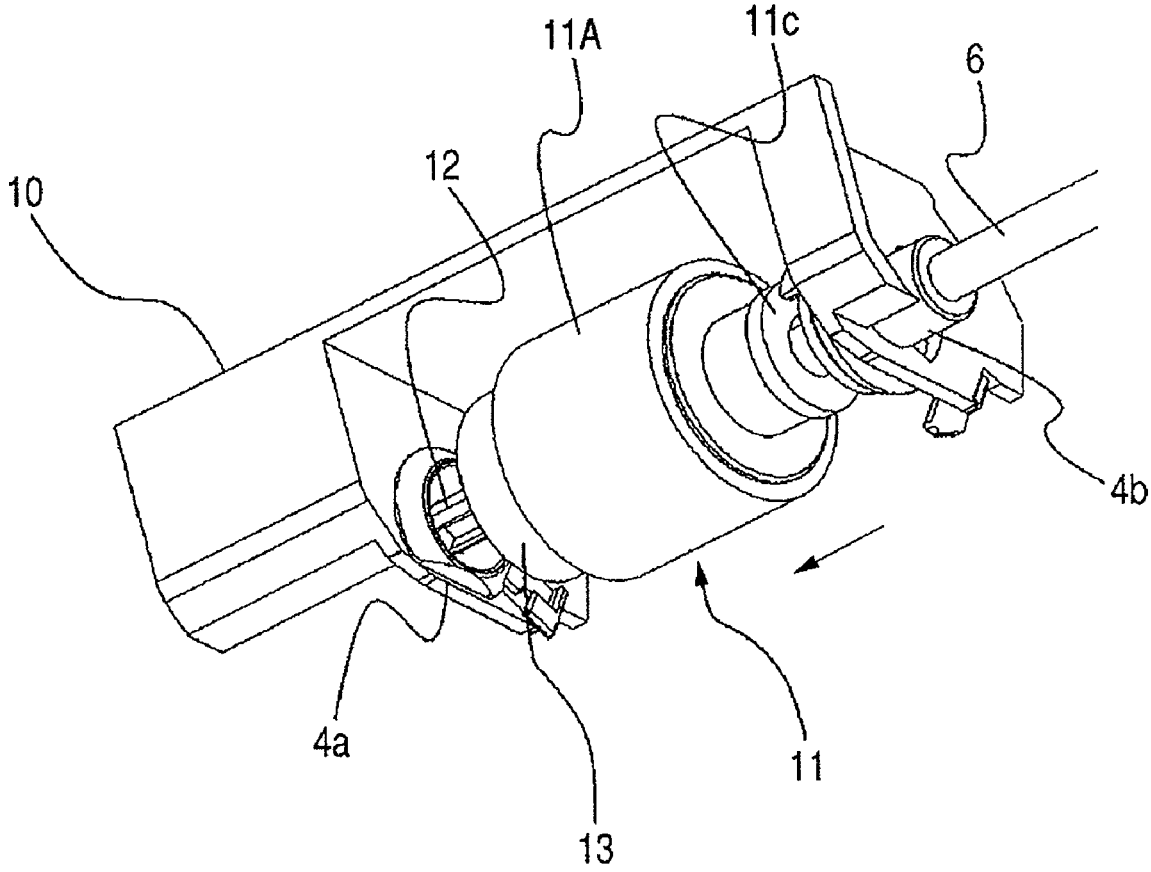
FIG. 20 PRIOR ART
FIG. 20 shows the construction of the feed roller portion of the conventional sheet feeding apparatus.

FIGS. 2A and 2B show the construction of the feed roller portion of the sheet feeding apparatus according to the present embodiment. In FIGS. 2A and 2B, the same reference characters as those in FIG. 20 already described designate the same or corresponding portions. Here, the feed roller 11 made into a unit is rotatably supported on a holder 10 which is a holding portion provided in the main body of the sheet feeding apparatus. The feed roller 11 has its roller body portion 11A constructed for sliding in the direction indicated by the arrow along a first roller shaft 12. The roller body portion 11A is formed integrally with a second roller shaft 11*c*.

Also, in FIGS. 2A and 2B, the reference numeral 20 denotes a lock mechanism provided near the feed roller 11, and this lock mechanism 20 has the function of making the sliding operation of the feed roller 11 along the first roller shaft 12 possible and impossible. This lock mechanism 20 has a lock lever 21, which is locking member provided with a claw portion 21*a*.

Figure 3A:
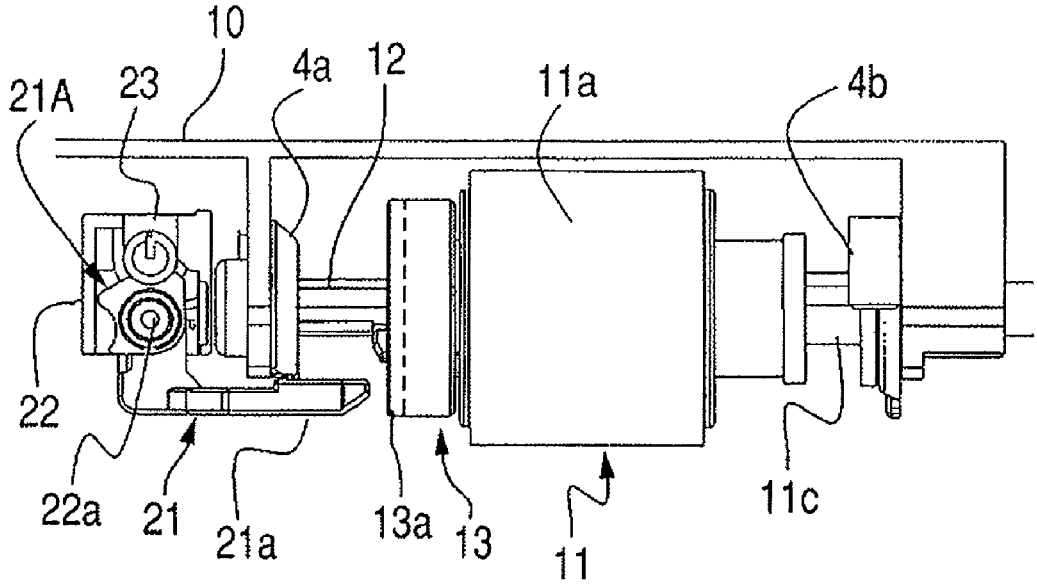
FIG. 3A is a view showing the locking state of the lock mechanism of the sheet feeding apparatus.
Figure 3B:
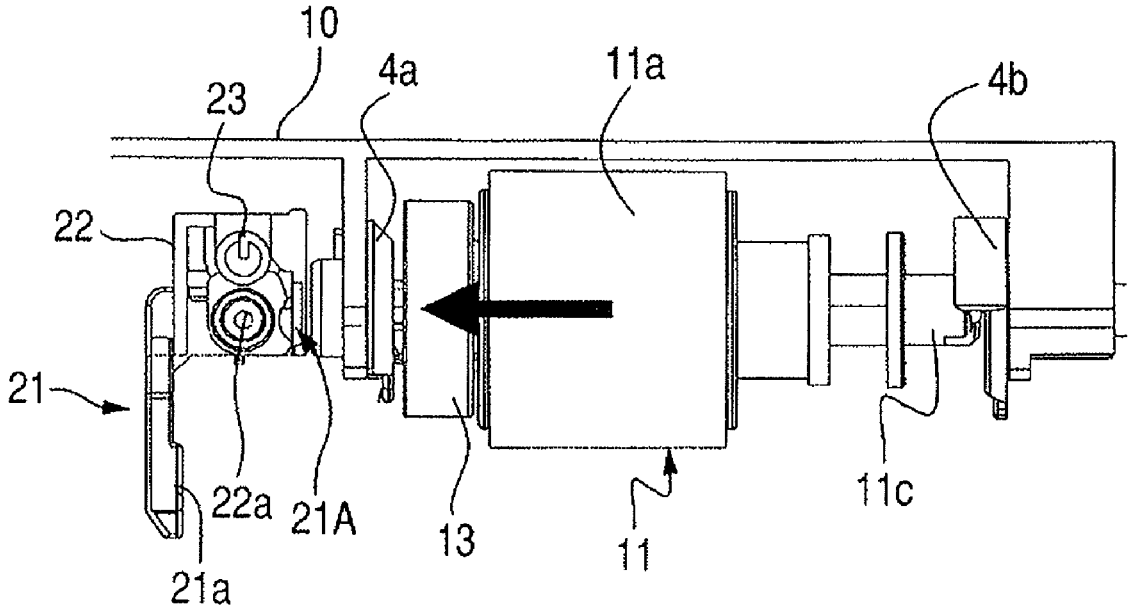
FIG. 3B is a view showing the lock releasing state of the lock mechanism of the sheet feeding apparatus.

FIGS. 3A and 3B show the constructions of the lock mechanism 20 and the feed roller 11, and FIG. 3A shows the state in which the lock mechanism 20 is in a lock state. At this time, the lock lever 21 is in a position wherein the claw portion 21*a* which is an abutment member faces the auxiliary cap 13 of the feed roller 11. When the lock lever 21 is in such a position, the sliding of the feed roller 11 can be regulated by the claw portion 21*a*.

FIG. 3B shows the state when the lock mechanism 20 is in a lock releasing state. At this time, the lock lever 21 is in a downwardly pivoted state. When the lock lever is in such a position, the feed roller 11 becomes slidable (movable) in a detaching direction indicated by the arrow. The second roller shaft 11*c* can be pulled out from the holder 10 to thereby detach the feed roller 11 from the main body of the apparatus.

Figure 4A:
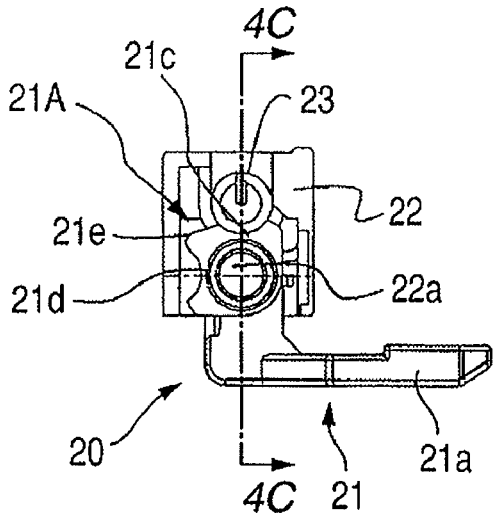
FIGS. 4A, 4B and 4C are views illustrating the construction of the lock mechanism.
Figure 4B:
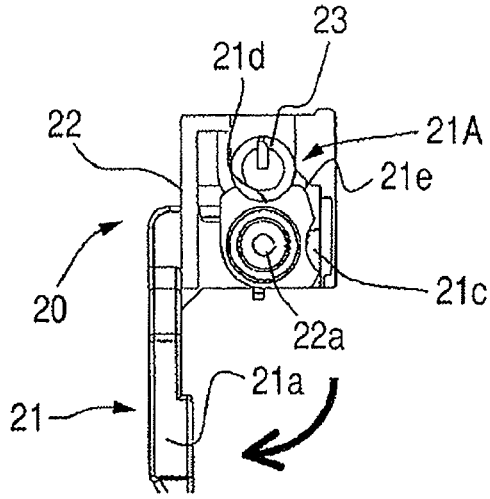
Figure 4C:
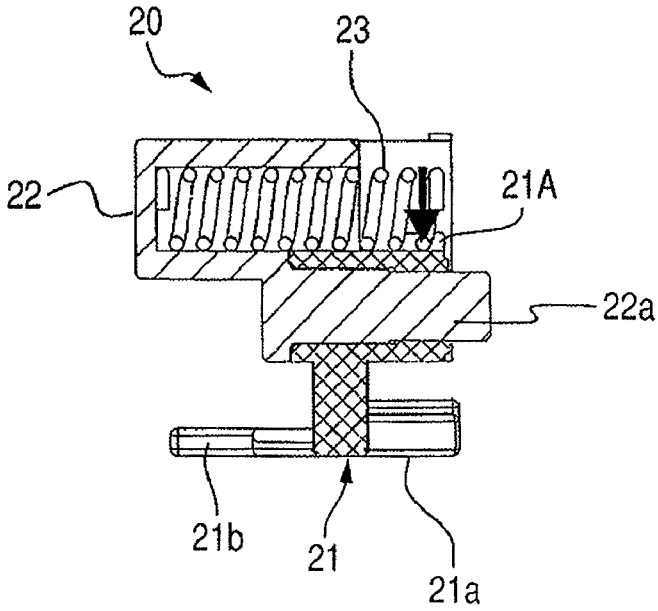

Also, FIGS. 4A, 4B and 4C are enlarged views of the lock mechanism 20, FIG. 4A shows the time when the lock mechanism 20 is in the lock state, and FIG. 4B shows the time when the lock mechanism is in the lock releasing state permitting the sliding of the feed roller 11. FIG. 4C is a cross-sectional view taken along line 4C-4C in FIG. 4A.

In FIGS. 4A, 4B and 4C, the reference numeral 22 designates a housing, and the lock lever 21 is supported for pivotal movement about a shaft 22*a* provided in the housing 22. The reference numeral 23 denotes a spring which is a resilient member, and this spring 23 has one end thereof fixed to the housing 22, and has the other end thereof fixed to the housing 22 with a portion thereof protruded outwardly from the housing 22.

The lock lever 21 is provided with a cam surface 21A, and the outer peripheral surface of that portion of the spring 23 protruding from the housing 22 is adapted to contact with the cam surface 21A (see FIG. 4C). This cam surface 21A is provided with a first concave portion 21*c* facing the spring 23 when the lock lever 21 is brought into a position wherein the claw portion 21*a* is in a horizontal state shown in FIG. 4A (hereinafter referred to as the lock position).

When the lock lever 21 is thus in the lock position (state), if the feed roller 11 slides, the tip end of the claw portion abuts against the auxiliary cap 13 of the feed roller 11 which has slid and therefore, the sliding operation of the feed roller 11 can be regulated. Thereby, the feed roller 11 can be prevented from being inadvertently detached.

Also, the cam surface 21A is provided with a second concave portion 21*d* facing the spring 23 when the lock lever 21 is brought into a position wherein the claw portion 21*a* is in a vertical state shown in FIG. 4B (hereinafter referred to as the lock releasing position). When the lock lever 21 is thus in the lock releasing position (state), the feed roller 11 becomes slidable in a detaching direction along the first roller shaft 12, and the feed roller 11 can be interchanged.

The cam surface 21A is further provided with a maximum convex portion 21*e* disposed between the first concave portion 21*c* and the second concave portion 21*d*, and smoothly continued to the first concave portion 21*c* and the second concave portion 21*d*.

When the lock lever 21 is rotated about the shaft 22*a*, the cam surface 21A is rotated while pushing up the spring 23, and the push-up amount of the spring 23 becomes maximum at a position whereat the maximum convex portion 21*e* faces the spring 23. At this time, the spring 23 generates a maximum force of restitution in a direction indicated by the arrow in FIG. 4C, and the force of restitution is exerted on the cam surface 21A.

Here, the cam surface 21A is formed with the first concave portion 21*c* and the second concave portion 21*d* and therefore, when the maximum convex portion 21*e* passes the spring 23 thereafter, the lock lever 21 is momentarily rotated to a position in which the first concave portion 21*c* or the second concave portion 21*d* faces the spring 23 by the force of restitution of the spring 23. Thereby, the spring 23 comes into the first concave portion 21*c* or the second concave portion 21*d* with a result that the lock lever 21 is momentarily moved to the lock position or the lock releasing position and is stably held in the lock position or the lock releasing position.

When for example, the lock lever 21 is downwardly pivoted, the maximum convex portion 21*e* first reaches a position facing the spring 23. After the maximum convex portion 21*e* has passed the spring 23, a force which pulls the lock lever 21 into the lock releasing position and with which the spring 23 comes into the second concave portion 21*d* is exerted on the lock lever 21 by the force of restitution of the spring 23.

Also, when the lock lever 21 is upwardly pivoted, the maximum convex portion 22*e* reaches the position facing the spring 23, and after the maximum convex portion 22*e* has passed the spring 23, a force which pulls the lock lever 21 into the lock position and with which the spring 23 comes into the first concave portion 21*c* is exerted on the lock lever 21 by the force of restitution of the spring 23.

That is, in the present embodiment, when the lock lever 21 is upwardly or downwardly pivoted, a force for moving the lock lever 21 to the lock position or the lock releasing position is exerted on the lock lever 21 by a toggle mechanism constituted by the cam surface 21A and the spring 23. The lock lever 21 is thus moved by the toggle mechanism, whereby the lock lever 21 can be reliably moved to and held in the lock position or the lock releasing position.

In the present embodiment, as shown in FIG. 2B, the auxiliary cap 13 is formed with a rib 13*a* along the outer peripheral surface thereof. If the roller body portion 11A of the feed roller 11 slides in the detaching direction when the lock lever 21 is in the lock position, the tip end portion of the claw portion 21*a* comes to be positioned inside this rib 13*a*.

Thereby, even if a strong force is exerted on the feed roller 11 and the roller body portion 11A slides in the detaching and therewith, the lock lever 21 is about to be pivoted in the lock releasing direction, this pivotal movement can be restricted because the tip end portion of the claw portion 21*a* is positioned inside the rib 13*a*.

As the result, even if a great force is exerted in the sliding direction of the feed roller 11 during the jam clearance or apparatus transportation in a state in which a sheet is nipped between the feed roller 11 and the separation roller 62 (sheet separating means), the feed roller can be prevented from being inadvertently detached.

In FIGS. 2A and 2B, the reference character 21*b* designates a handy-grip portion, and the changeover of the lock/lock releasing of the lock lever 21 can be arbitrarily performed by the user (or the serviceman) with the aid of the operation of this handy-grip portion 21*b*.

For example, the user can operate this handy-grip portion 21*b* and downwardly pivot the lock lever 21 to thereby change over the lock lever 21 to the lock releasing state, and can easily interchange the feed roller 11. Here, the changeover of the lock/lock releasing can be smoothly performed by the toggle mechanism already described.

Now, in a case where such a lock mechanism 20 is provided, it is sometimes the case that the user forgets to return the lock lever 21 to the lock state after the user has interchanged the feed roller 11. In such case, when the sheet feeding cassette 70 is mounted, the lock lever 21 may abut against the sheets P stacked on the inner plate 73 shown in FIG. 1 to thereby cause the occurrence of faulty feeding. Also, even when the sheet P has been fed, the sheet may be injured by the lock lever 21, or the skew feed or jam of the sheet may be caused.

So, in the present embodiment, design is made such that even when the user has forgotten to return the lock lever 21 to the lock position, the lock lever 21 can be changed over from the lock releasing position to the lock position in operative association with the mounting operation of the sheet feeding cassette 70.

Figure 5A:
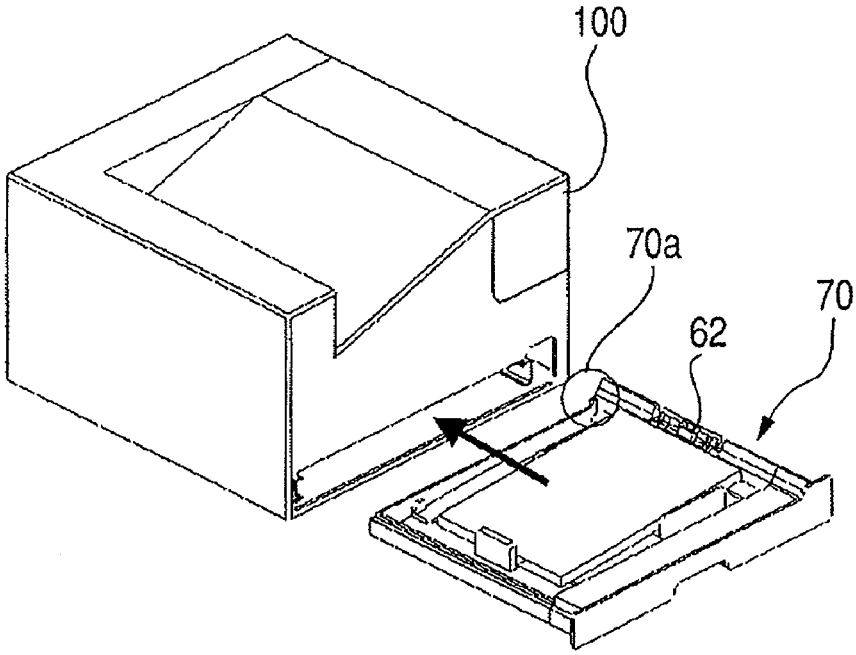
FIG. 5A is a view showing the mounting direction of the sheet feeding cassette of the sheet feeding apparatus.
Figure 5B:
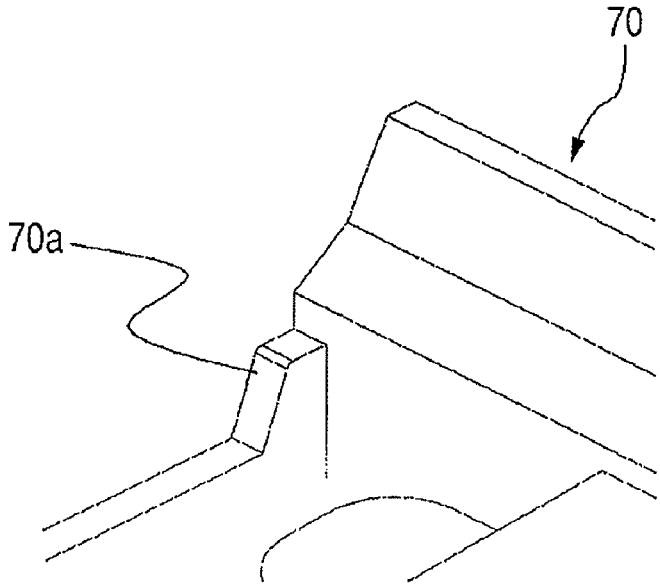
FIG. 5B is a view illustrating the construction of the sheet feeding cassette of the sheet feeding apparatus.

In the present embodiment, the mounting direction of the sheet feeding cassette 70, as shown in FIG. 5A, is a direction orthogonal to a sheet conveying direction, i.e., the sliding direction of the feed roller 11. So, the sheet feeding cassette 70 mounted in such a direction is provided with a lock lever pressing portion 70*a* which is position changeover means interfering with the lock lever 21 being in the lock releasing position during the mounting, as shown in FIG. 5B.

Here, the height of the lock lever pressing portion 70*a* provided in the sheet feeding cassette 70 is set to such a height that it does not interfere with the lock lever 21 being in the lock position and the feed roller 11, but interferes with the lock lever 21 being in the lock releasing position. Also, the height of the lock lever pressing portion 70*a* is set to such a height that it can push in the lock lever 21 and pivotally move the lock lever 21 until at least the maximum convex portion 21*e* of the cam surface 21A of the lock lever 21 goes over the position facing the spring 23.

Figure 6A:
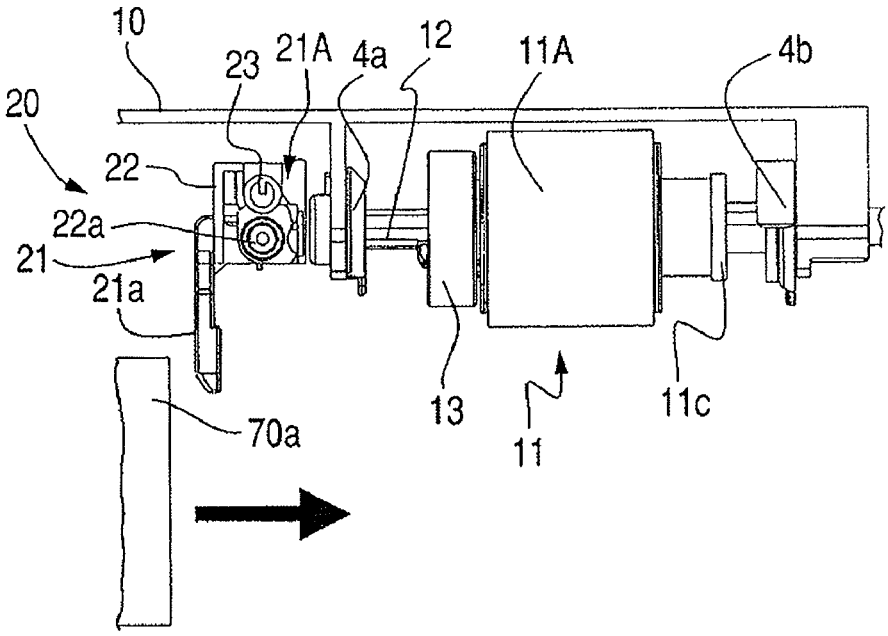
FIGS. 6A, 6B and 7 are views illustrating the operation of the lock mechanism resulting from the mounting operation of the sheet feeding cassette.
Figure 6B:
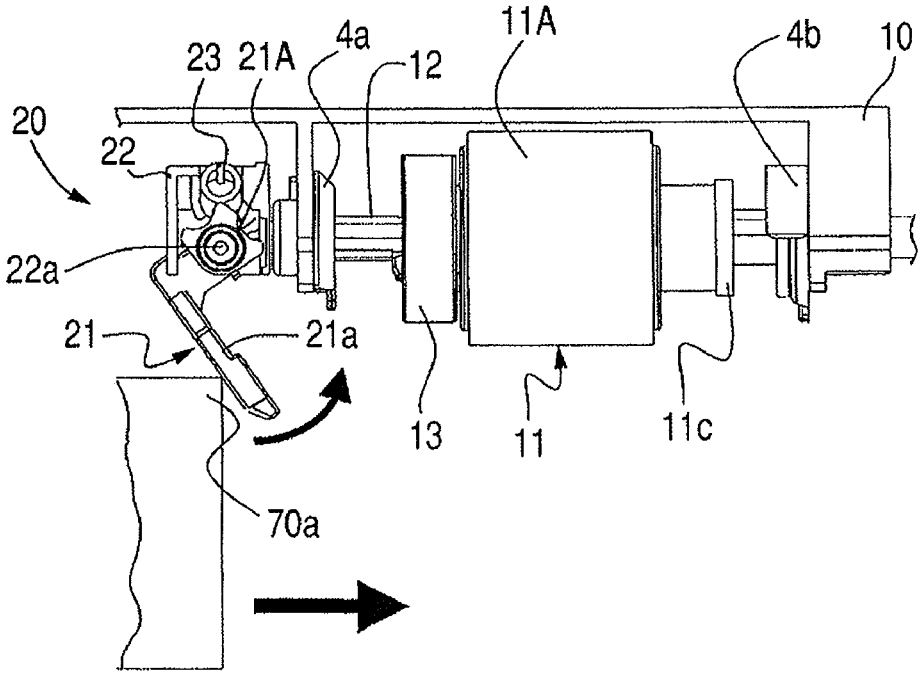
Figure 7:
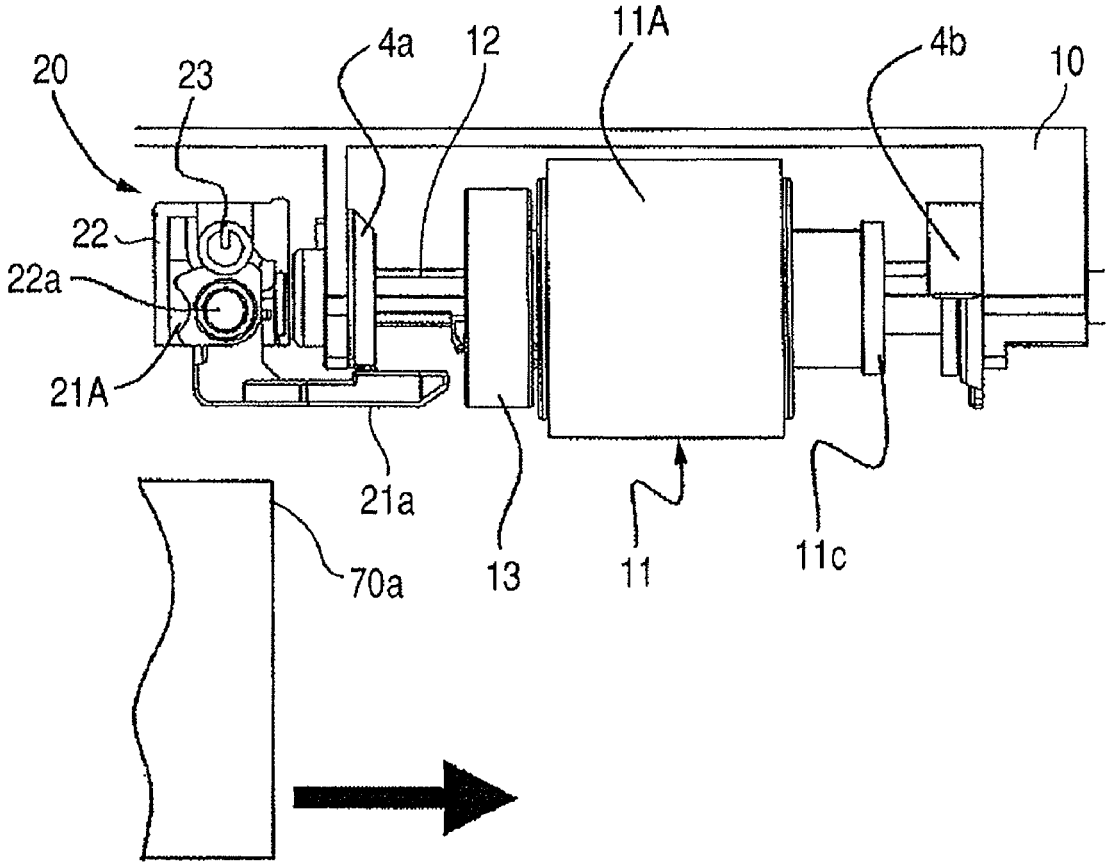

FIGS. 6A, 6B and 7 show the state when the sheet feeding cassette 70 provided with such a lock lever pressing portion 70*a* is mounted when the lock lever 21 is in the lock releasing position. First, when as shown in FIG. 6A, the lock lever 21 is in the lock releasing position, if the sheet feeding cassette 70 is mounted in the direction indicated by the arrow, the lock lever pressing portion 70*a* abuts against the claw portion 21*a* of the lock lever 21.

When the sheet feeding cassette 70 is further mounted in the direction indicated by the arrow, as shown in FIG. 6B, the lock lever 21 is pressed by the lock lever pressing portion 70*a* and begins to be upwardly pivoted. Thereafter, the lock lever 21 is pivotally moved by the lock lever pressing portion 70*a* until the maximum convex portion 21*e* of the cam surface 21A goes over the position facing the spring 23, whereupon the lock lever 21 is pulled in by the toggle mechanism and is changed over to the lock position as shown in FIG. 7.

That is, if the sheet feeding cassette 70 is mounted when the lock lever 21 is in the lock releasing position, the lock lever 21 is pressed by the lock lever pressing portion 70*a* provided in the sheet feeding cassette 70 and is pivotally moved to the lock position.

When the lock lever 21 is thus in the lock releasing position, the lock lever 21 is moved to the lock position in operative association with the mounting operation of the sheet feeding cassette 70, whereby the lock lever 21 can be reliably changed over to the lock position.

As the result, even if the user has forgotten to return the lock lever 21 to the lock position, the lock lever 21 can be changed over from the lock releasing position to the lock position in operative association with the mounting operation of the sheet feeding cassette 70. Thereby, the sheet feeding cassette 70 can be prevented from being mounted with the lock lever 21 being in the lock releasing state, and as the result, the occurrence of the faulty feeding, injury, jam, etc. of the sheet can be prevented and an improvement in usability can be achieved.

A second embodiment of the present invention will now be described.

Figure 8A:
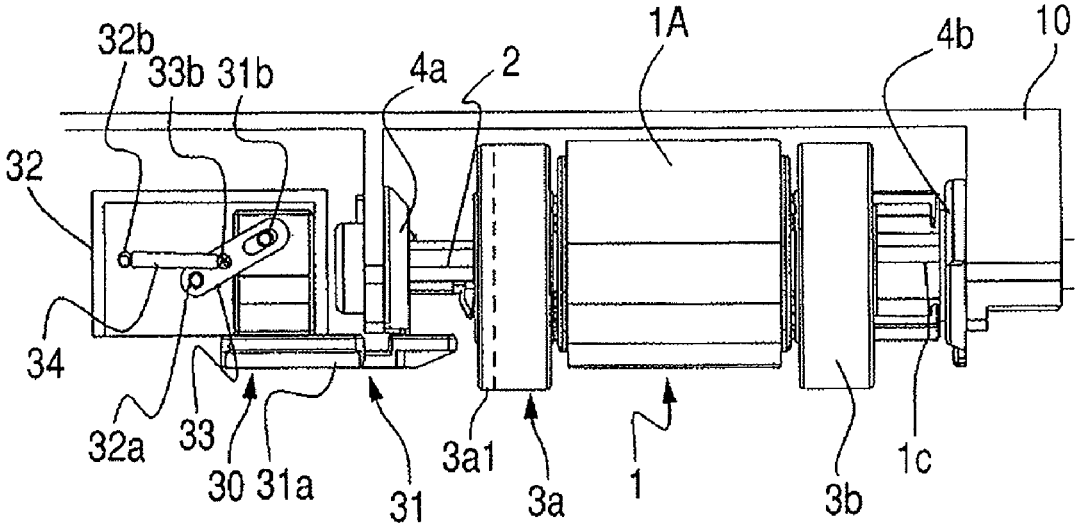
FIG. 8A is a view showing the locking state of the lock mechanism of a sheet feeding apparatus according to a second embodiment of the present invention.
Figure 8B:
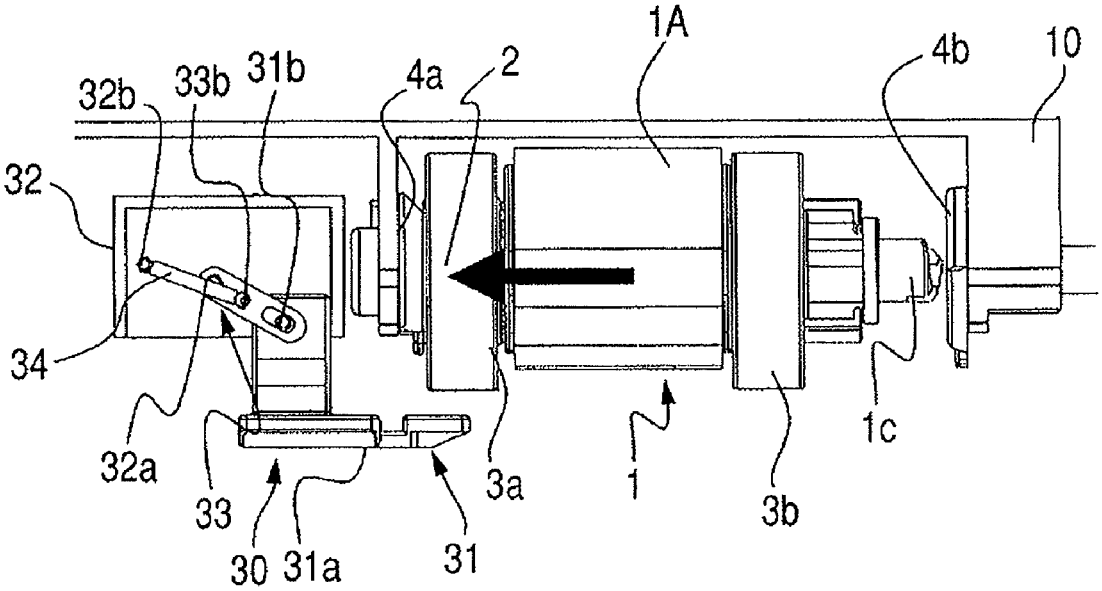
FIG. 8B is a view showing the lock releasing state of the lock mechanism of the sheet feeding apparatus according to the second embodiment of the present invention.
Figure 15A:
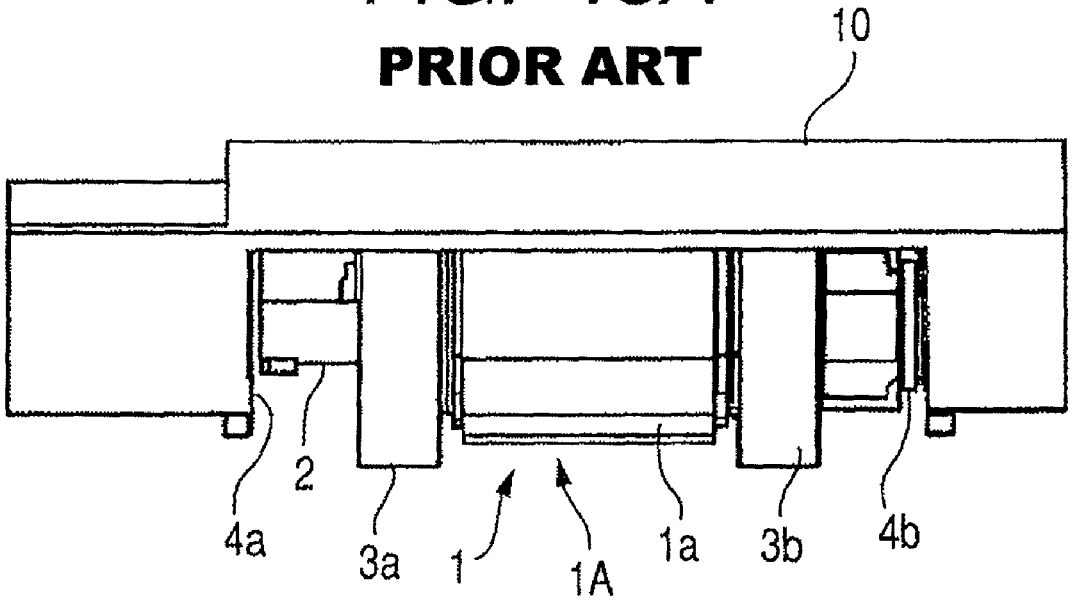
FIG. 15A PRIOR ART
FIGS. 15A and 15B are views illustrating the mounted state of the feed roller.
Figure 15B:
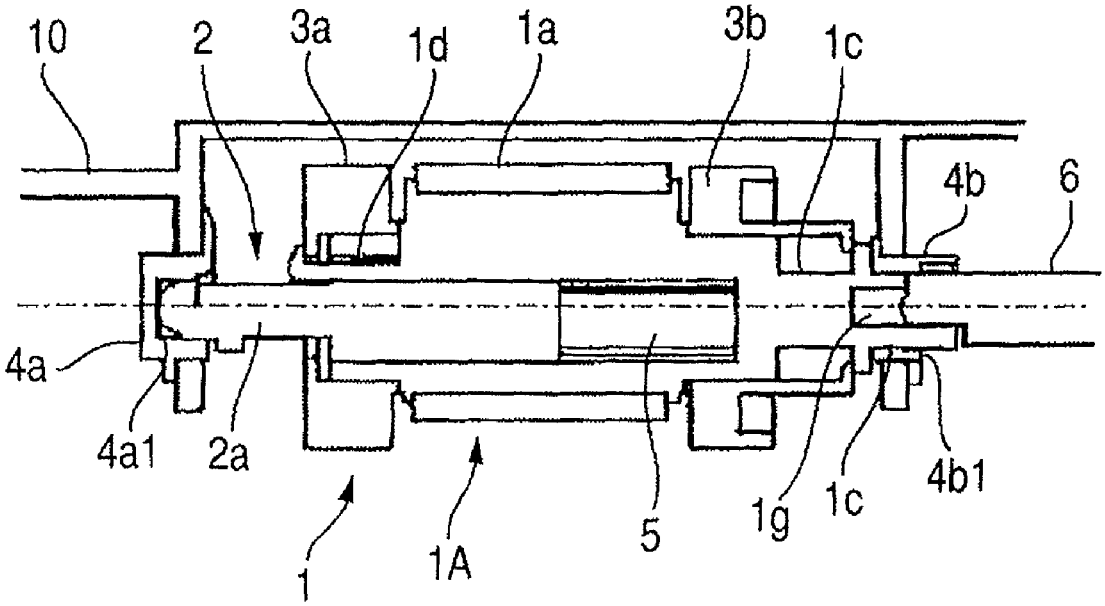
FIG. 15B PRIOR ART
Figure 16A:
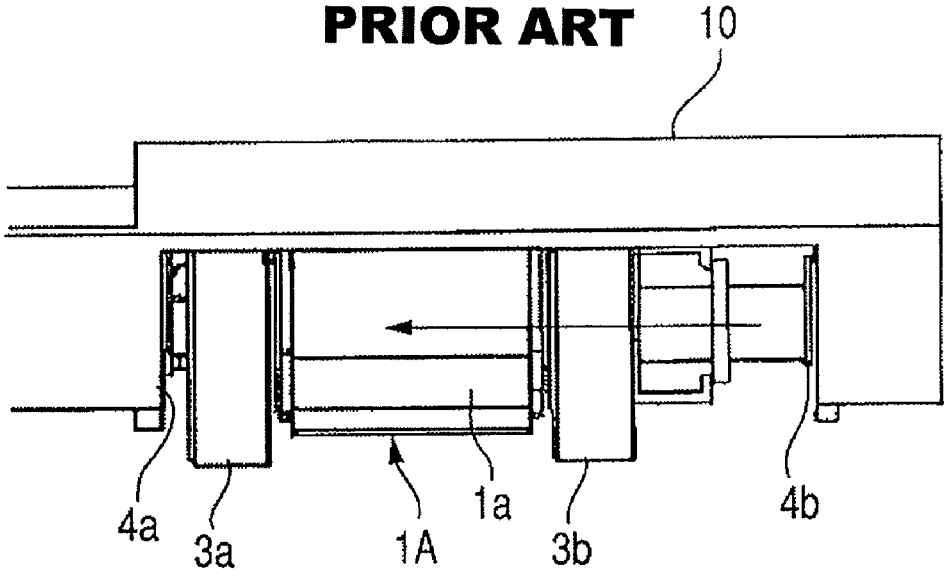
FIG. 16A PRIOR ART
FIGS. 16A and 16B are first views illustrating the detaching operation of the feed roller.
Figure 16B:
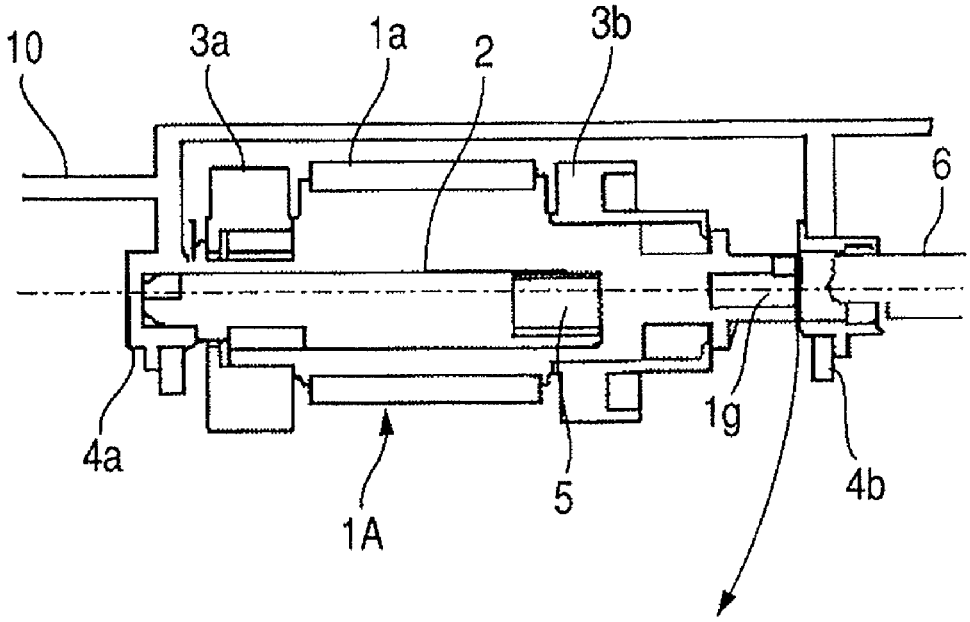
FIG. 16B PRIOR ART
Figure 17:
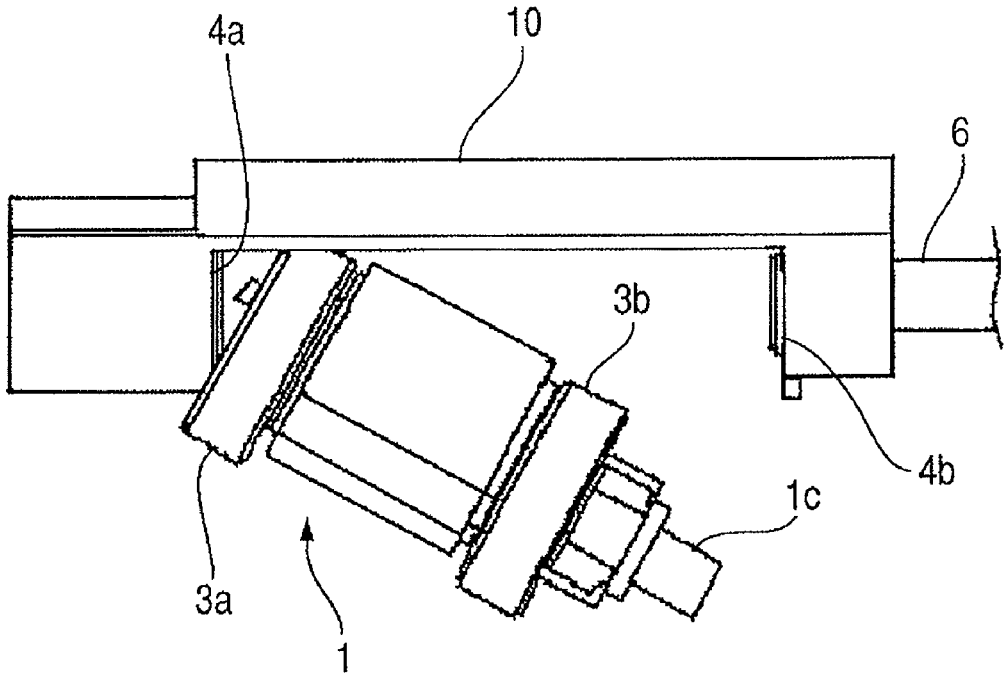
FIG. 17 PRIOR ART
FIG. 17 is a second view illustrating the detaching operation of the feed roller.

FIGS. 8A and 8B show the construction of the vicinity of the feed roller of a sheet feeding apparatus according to the present embodiment, and in FIGS. 8A and 8B, the same reference characters as those in FIGS. 15A and 15B already described designate the same or corresponding portions.

In the present embodiment, the feed roller 1 is of a construction in which the sheet is separated by a separation pad, and the roller body portion 1A is designed for sliding along the first roller shaft 2.

In FIGS. 8A and 8B, the reference numeral 30 denotes a lock mechanism provided near the feed roller 1, and this lock mechanism 30 has the function of making the sliding movement of the feed roller 1 along the first roller shaft 2 possible and impossible. This lock mechanism 30 has a lock lever 31 which is locking member provided with a claw portion 31*a* which is an abutment member.

FIG. 8A shows the situation when the lock mechanism 30 is in the locking state. At this time, the lock lever 31 is in a position in which the claw portion 31*a* faces the rotatable member 3*a* of the feed roller 1. When the lock lever 31 is in such a position, the sliding of the feed roller 1 in the detaching direction can be restricted by the claw portion 31*a*.

Also, FIG. 8B shows the situation when the lock mechanism 30 is in the lock releasing state. At this time, the lock lever 31 is in a downwardly slid state. When the lock lever 31 is in such a position, the feed roller 1 becomes slidable (movable) in the detaching direction indicated by the arrow.

In the present embodiment, the first rotatable member 3*a* provided in the feed roller 1 is provided with a rib 3*a*1, as in the first embodiment. If the roller body portion 1A of the feed roller 1 slides in the detaching direction when the lock lever 31 is in the lock position, the tip end portion of the claw portion 31*a* comes to be positioned inside this rib 3*a*1.

Thereby, even if a strong force is exerted on the feed roller 1 and the roller body portion 1A slides in the detaching direction and therewith, the lock lever 31 is about to be pivotally moved in the lock releasing direction, this pivotal movement can be restricted because the tip end portion of the claw portion 31*a* is positioned inside the rib 3*a*1. As the result, even if during jam clearance or apparatus transportation, a great force is applied in the sliding direction of the feed roller 1, the lock lever 31 is not lowered and the feed roller 1 can be prevented from being inadvertently detached.

In FIGS. 8A and 8B, the reference numeral 32 designates a housing, and by this housing 32, the lock lever 31 is supported for sliding in a vertical direction. The reference numeral 33 denotes a link member having one end thereof connected to a shaft 31*b* provided on the lock lever 31, and having the other end thereof supported by a first fixed shaft 32*a* provided in the housing 32.

The reference numeral 34 designates a spring having one end thereof connected to a second fixed shaft 33*a* provided on the link member 33, and having the other end thereof connected to a third fixed shaft 32*b* provided in the housing 32. Here, the first to third fixed shafts 32*a*, 33*a* and 32*b* are disposed so that with the position of the lock lever 31 in which the first to third fixed shafts 32*a*, 33*a* and 32*b* are arranged in a straight line as the boundary, pulling-in forces may be generated to the lock lever 31 toward the lock position and the lock releasing position, respectively.

That is, in the present embodiment, by the link member 33 and the spring 34, as in the first embodiment, the lock lever 31 is constructed so as to have a toggle mechanism. By the provision of such a toggle mechanism, the position of the lock lever 31 can be reliably changed over to the lock position in which the claw portion 31*a* faces the feed roller 1, and the lock releasing position in which the claw portion 31*a* is retracted downwardly of the feed roller 1 and permits the sliding movement of the feed roller 1.

Again in the present embodiment, even if after the interchange of the feed roller, the user (or the serviceman) has forgotten to change over the lock mechanism 30 to the lock state, the sheet feeding cassette 70 can be mounted to thereby change over the lock lever 31 to the locking state.

Figure 9A:
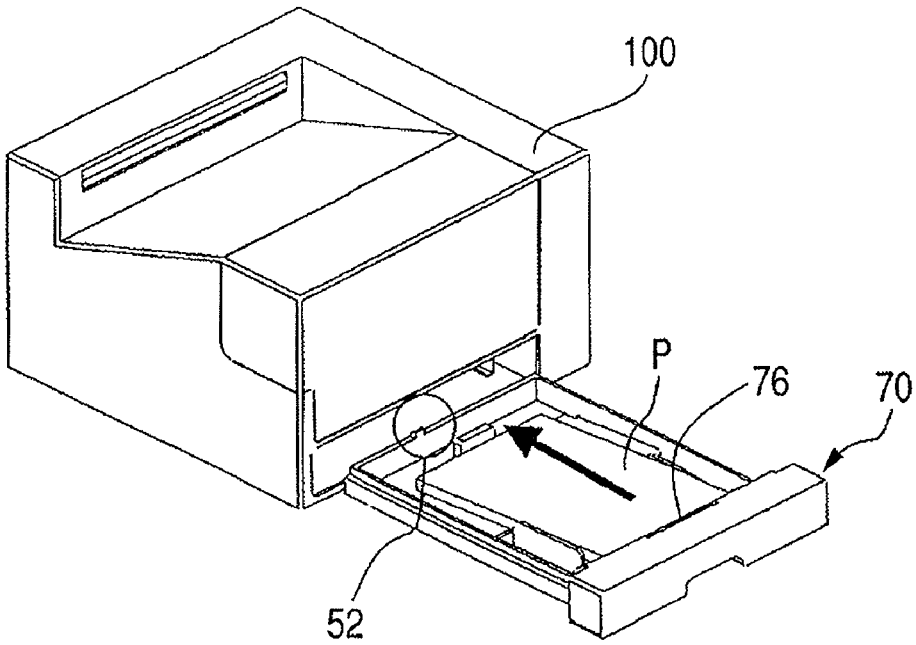
FIG. 9A is a view showing the mounting direction of the sheet feeding cassette of the sheet feeding apparatus.
Figure 9B:
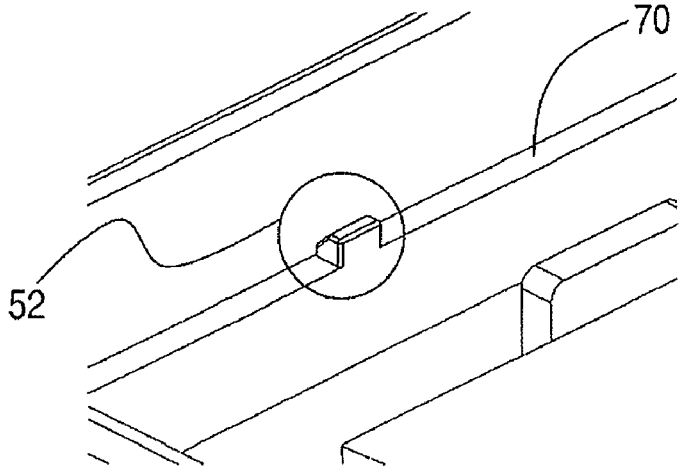
FIG. 9B is a view illustrating the construction of the sheet feeding cassette of the sheet feeding apparatus.

FIGS. 9A and 9B show the mounting direction of the sheet feeding cassette 70 in the present embodiment, and the construction of the sheet feeding cassette 70. In the present embodiment, the mounting direction of the sheet feeding cassette 70, as shown in FIG. 9B, is the sheet conveying direction, i.e., a direction orthogonal to the sliding direction of the feed roller 1. So, the sheet feeding cassette 70 mounted in such a direction is provided with a lock lever pressing portion 52 at a position whereat as shown in FIG. 9B, it interferes with the lock lever 31 being in the lock releasing state during the mounting.

Here, the height of the lock lever pressing portion 52 provided in the sheet feeding cassette 70 is set to such a height that it does not interfere with the feed roller 1 and the lock lever 31 being in the lock position, but interferes with the lock lever 31 being in the lock releasing position. Also, the height of the lock lever pressing portion 52 is set to such a height that it pushes in the lock lever 31 and pushes it up to a position higher than at least the position at which the first to third fixed shafts 32*a*, 33*a* and 32*b* in the lock mechanism 30 are arranged in a straight line.

Figure 10A:
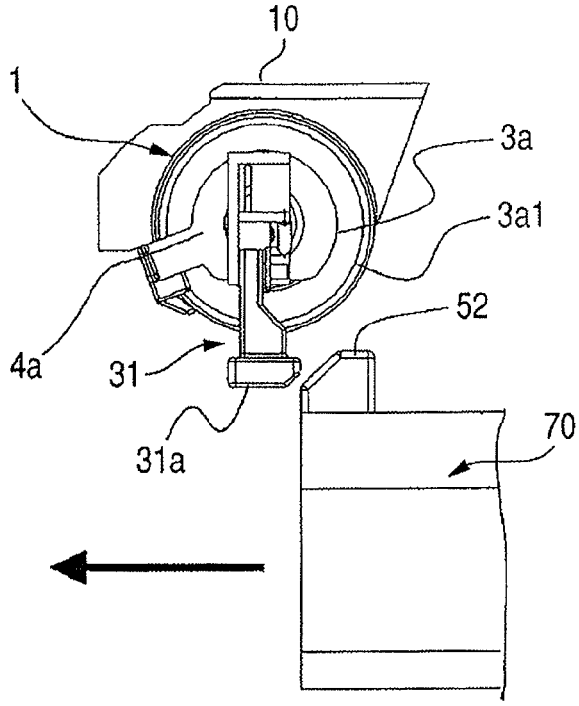
FIGS. 10A, 10B and 11 are views illustrating the operation of the lock mechanism resulting from the mounting operation of the sheet feeding cassette.
Figure 10B:
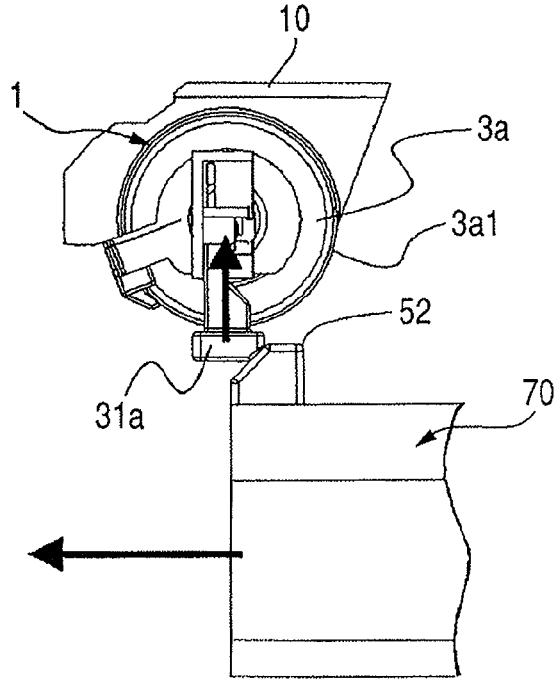
Figure 11:
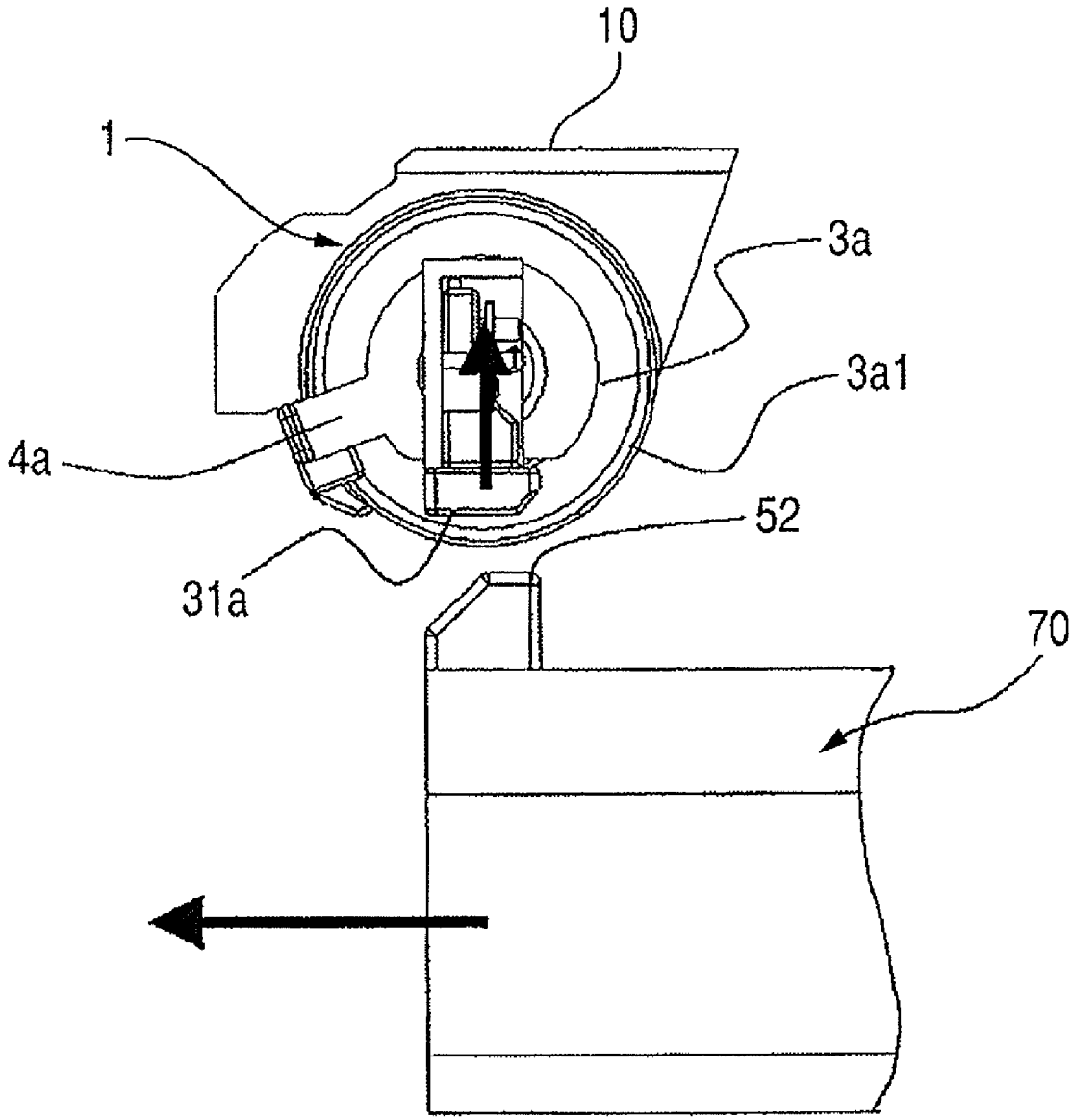
Figure 12:
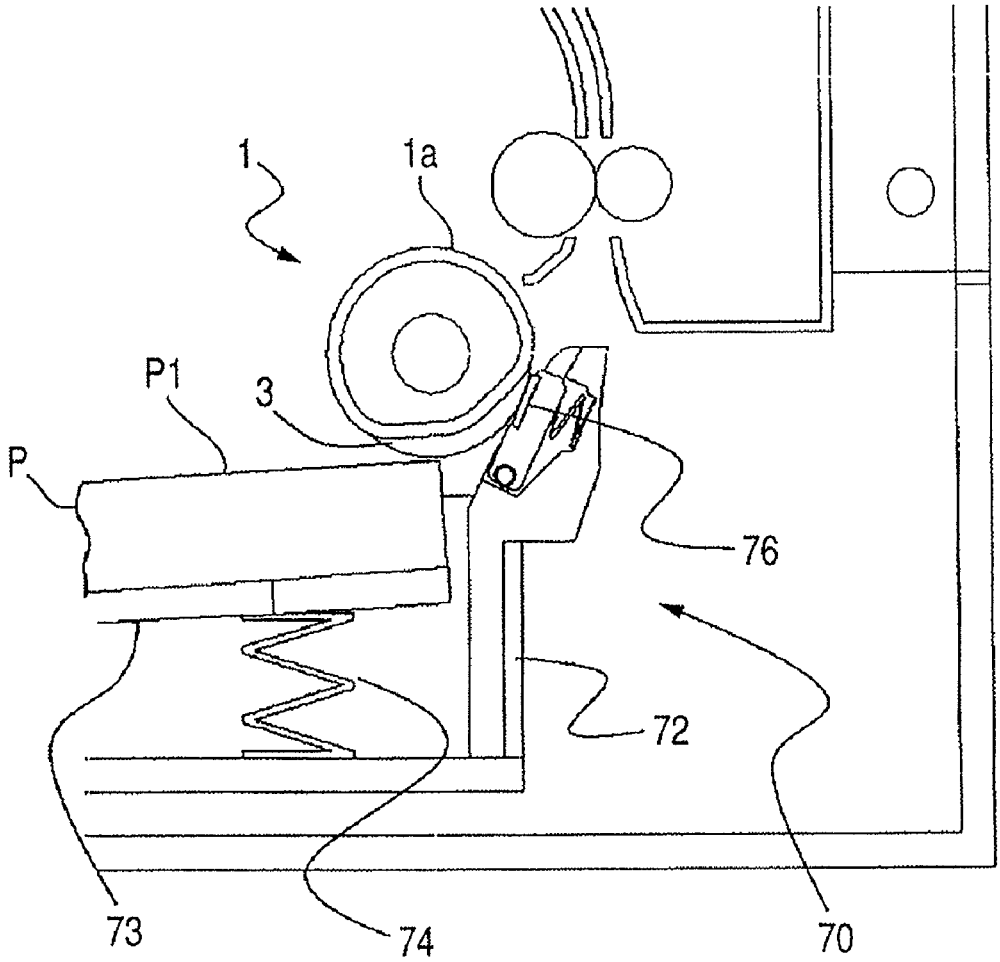
FIG. 12 PRIOR ART
FIG. 12 is a view showing the construction of a conventional sheet feeding apparatus.
Figure 13:
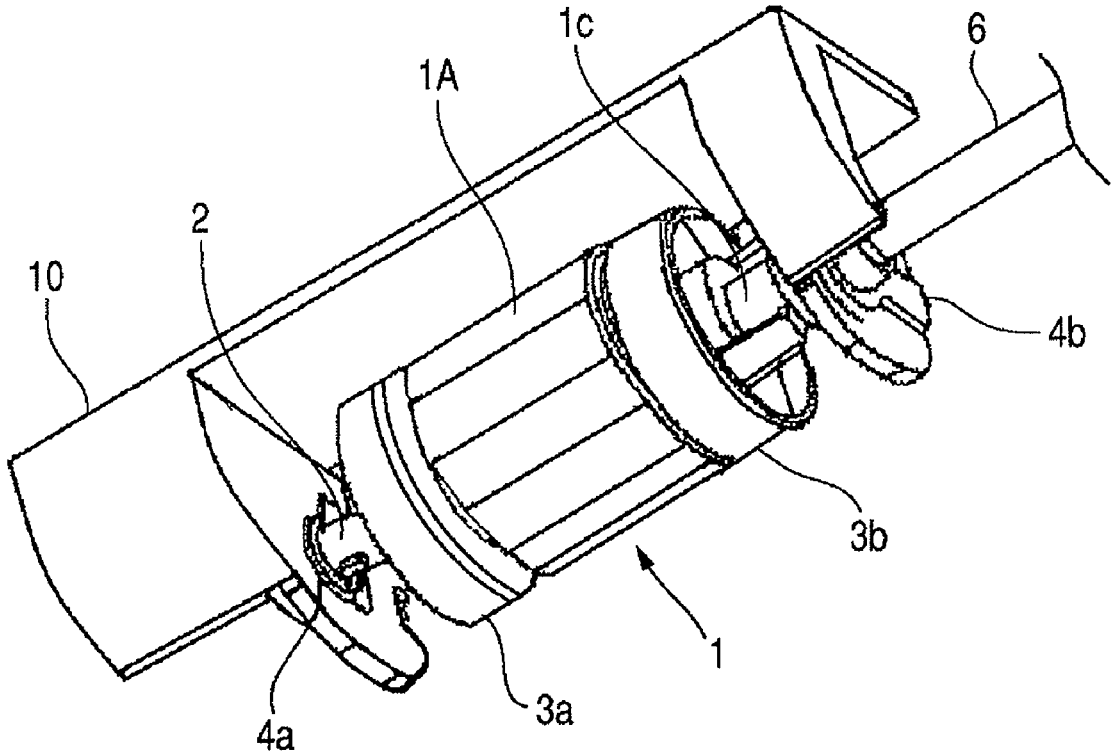
FIG. 13 PRIOR ART
FIG. 13 is a view showing the construction of the feed roller portion of the conventional sheet feeding apparatus.
Figure 14:
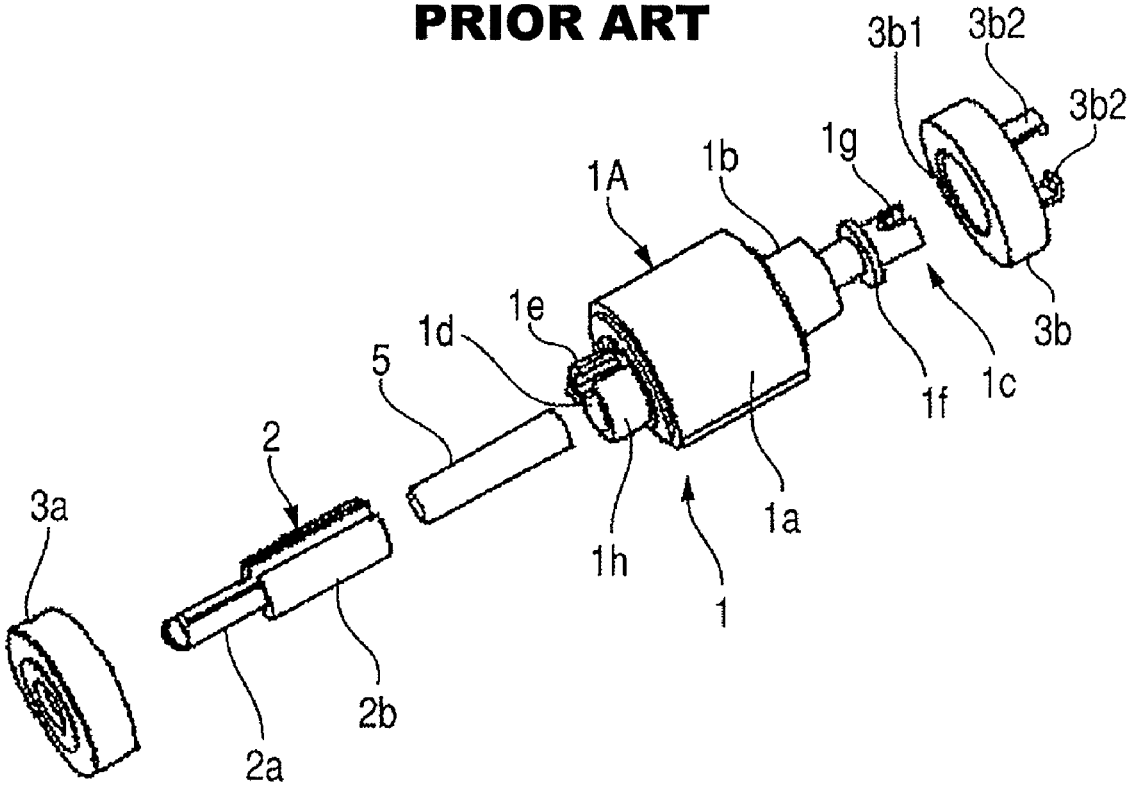
FIG. 14 PRIOR ART
FIG. 14 is an exploded perspective view of the feed roller.

FIGS. 10A, 10B and 11 show the situation when the sheet feeding cassette 70 provided with such a lock lever pressing portion 52 is mounted when the lock lever 31 is in the lock releasing position. First, when as shown in FIG. 10A, the lock lever 31 is in the lock releasing position, if the sheet feeding cassette 70 is mounted in the direction indicated by the arrow, the lock lever pressing portion 52 abuts against the lock lever 31.

Here, that surface of the lock lever pressing portion 52 which abuts the lock lever 31 and that surface of the lock lever 31 against which the lock lever pressing portion 52 are inclined surfaces. Therefore, when the sheet feeding cassette 70 is further mounted in the direction indicated by the arrow, the lock lever 31 is pressed by the lock lever pressing portion 52 and begins to be upwardly moved, as shown in FIG. 10B.

When thereafter, the lock lever 31 is raised to a level higher than the height at which the first to third fixed shafts 32*a*, 33*a* and 32*b* are arranged in a straight line, by the lock lever pressing portion 52, the lock lever is momentarily changed over to the lock position, as shown in FIG. 11, by the toggle mechanism of the lock mechanism 30.

That is, if the sheet feeding cassette 70 is mounted when the lock lever 31 is in the lock releasing position, the lock lever 31 is pressed by the lock lever pressing portion 52 provided in the sheet feeding cassette 70 and slides to the lock position.

As the result, even if the user has forgotten to return the lock lever 31 to the lock state, the lock lever 31 can be changed over from the lock releasing state to the lock state in operative association with the mounting operation of the sheet feeding cassette 70. Thereby, the lock lever 31 can be prevented from being in the lock releasing state although the sheet feeding cassette 70 is mounted, and as the result, the occurrence of faulty feeding, injury and jam of the sheet can be prevented and an improvement in usability can be achieved.

Now, the position of the lock lever pressing portion hitherto described is not restrictive, but can be any position in which the lock lever being in the lock releasing state can be changed over to the lock state in operative association with the mounting operation of the sheet feeding cassette. The construction of the toggle mechanism of the lock lever is not restricted to the already described construction, but may be any construction having a toggle function. Also, the sheet separating means is not restricted to the separation pad or the separation roller, but other means may be used.

This application claims the benefit of Japanese Patent Application No. 2005-374768, filed Dec. 27, 2005, which is hereby incorporated by reference herein in its entirety.

What is claimed is:

1. A sheet feeding apparatus provided with a sheet feeding cassette detachably mounted on a main body of an apparatus, and a feed roller for feeding a sheet stacked on said sheet feeding cassette, said sheet feeding apparatus comprising:

a holding portion provided in the main body of the apparatus, having said feed roller rotatably supported on said holding portion, and detachably holding said feed roller; and a locking member movable to a lock position for restricting a detachment of said feed roller, and a lock releasing position for permitting the detachment of said feed roller, wherein when said sheet feeding cassette is mounted to the main body, said locking member is located in a position that is not pushed by said sheet feeding cassette at the lock position and is located in a position that is pushed by said sheet feeding cassette at the lock releasing position, wherein the locking member is pivotally moved between the lock position and the lock releasing position, and when said locking member is in the lock releasing position with said sheet feeding cassette drawn out from the main body of the apparatus, said locking member is moved to the lock position by being pushed by said sheet feeding cassette in association with a mounting operation of said sheet feeding cassette.

2. A sheet feeding apparatus according to claim 1, further comprising a toggle mechanism for pulling said locking member into the lock position, wherein by the mounting operation of said sheet feeding cassette, said locking member is moved from the lock releasing position to a position in which said toggle mechanism operates.

3. An image forming apparatus provided with a sheet feeding apparatus provided with a sheet feeding cassette detachably mounted on a main body of said image forming apparatus, and a feed roller for feeding a sheet stacked on said sheet feeding cassette, and an image forming portion for forming an image on the sheet fed out from said sheet feeding apparatus, said image forming apparatus comprising:

a holding portion provided in said main body of said image forming apparatus, and having said feed roller rotatably supported on said holding portion, and detachably holding said feed roller; and a locking member movable to a lock position for restricting a detachment of said feed roller, and a lock releasing position for permitting the detachment of said feed roller, wherein when said sheet feeding cassette is mounted to the main body, said locking member is located in a position that is not pushed by said sheet feeding cassette at the lock position and is located in a position that is pushed by said sheet feeding cassette at the lock releasing position, wherein the locking member is pivotally moved between the lock position and the lock releasing position, and when said locking member is in the lock releasing position with said sheet feeding cassette drawn out from said main body of said image forming apparatus, said locking member is moved to the lock position by being pushed by said sheet feeding cassette in association with a mounting operation of said sheet feeding cassette.

4. An image forming apparatus according to claim 3, further comprising a toggle mechanism for pulling said locking member into the lock position, wherein by the mounting operation of said sheet feeding cassette, said locking member is moved from the lock releasing position to a position in which said toggle mechanism operates.

* * * * *